US005802878A

United States Patent [19]

Nakamori et al.

[11] Patent Number: 5,802,878

[45] Date of Patent: Sep. 8, 1998

[54] NEEDLE SELECTION DEVICE OF FLAT KNITTING MACHINE

[75] Inventors: Toshinori Nakamori, Wakayama; Yoshiteru Koyama, Tanabe; Hiroyuki Ueyama, Wakayama; Toshiaki Morita, Kaisou-gun, all of Japan

[73] Assignee: Shima Seiki Manufacturing, Ltd., Wakayama, Japan

[21] Appl. No.: 904,023

[22] Filed: Jul. 31, 1997

Related U.S. Application Data

[62] Division of Ser. No. 663,546, Jun. 13, 1996, Pat. No. 5,694,792.

[30] Foreign Application Priority Data

Jun. 15, 1995 [JP] Japan ..... 7-148466
Dec. 28, 1995 [JP] Japan ..... 7-344049

[51] Int. Cl.[6] ..... D04B 15/72

[52] U.S. Cl. ..... 66/64; 66/60 R

[58] Field of Search ..... 66/60 R, 64

[56] References Cited

U.S. PATENT DOCUMENTS

| | | | |
|---|---|---|---|
| 3,304,748 | 2/1967 | Seiler | 66/64 |
| 4,905,483 | 3/1990 | Shima | 66/64 |
| 5,369,965 | 12/1994 | Shima et al. | 66/64 |
| 5,469,717 | 11/1995 | Shibuta et al. | 66/64 X |

*Primary Examiner*—John J. Calvert
*Attorney, Agent, or Firm*—Nikaido, Marmelstein Murray & Oram LLP

[57] ABSTRACT

Needle beds are provided with needles, needle jacks and select jacks and selectors, and the selectors are provided with three butts. The front butt is made to contact the reference plane of the carriage to serve as the fulcrum of rocking. The second butt is used to withdraw the selector, and the tail butt is used to advance the selector. Two pressing cams of the carriage press the tail butt to make the selector to be attracted by a permanent magnet. Two raising cams of the carriage advance the selector to the H position and the A position.

2 Claims, 7 Drawing Sheets

NEEDLE SELECTION DEVICE OF FLAT KNITTING MACHINE

This is a division of application Ser. No. 08/663,546 filed Jun. 13, 1996, now U.S. Pat. No. 5,694,792.

FILED OF THE INVENTION

This invention relates to a needle selection device of a flat knitting machine.

PRIOR ART

A large number of needles are arranged in the needle beds of a flat knitting machine. A carriage that reciprocates over the needle beds is provided with needle selection devices, and these needle selection devices select needles according to the knitting data to move needles forwards or backwards. As a result, the flat knitting machine can knit fabrics of jacquard, design pattern, etc.

With regard to related prior art, known needle selection devices of flat knitting machine include one using a rocking electromagnet described in the Japanese Provisional Patent Publication Hei-6-29118 and those using a fixed electromagnet described in the Japanese Patent Hei-1-38898 (corresponding to U.S. Pat. No. 4,686,839) and the Japanese Provisional Patent Publication Hei-5-321102. Needle selection devices using a fixed electromagnet can select needles at a higher speed than those using a rocking electromagnet and has fewer troubles during knitting because the selector actuator is fixed therein.

The fixed electromagnet of the selector actuator may be of an exciting hold type that attracts the desired selector by exciting the coil of the pole and of an exciting release type that releases the desired selector by exciting the coil of the pole. The needle selection device of the exciting release type allows easy handling at the time of a power failure or at the time of power recovery after a power failure.

The Japanese Patent Hei-1-38898 describes a needle selection device of the exciting release type. In this needle selection device, the needle beds are provided with selectors, and at the virtual center of each selector is provided a rocking fulcrum. The top of the tip of the selector is the pole contact that is attracted by the selector actuator, and the top of the tail of the selector is pressed by the pressing cam. A control butt provided near the tail is pressed upward by a spring so that the butt protrudes out of the needle groove. The carriage that reciprocates over the needle beds is provided with the pressing cam on a position along the tails of the selectors. The pressing cam makes the tail of the selector descend into the needle groove and makes the pole contact protrude out of the needle groove. The carriage is provided with selector actuator comprising a permanent magnet and an electromagnet. The permanent magnet attracts the pole contact, and the electromagnet cancels the magnetic flux of the permanent magnet to undo the attraction of the selector. In this way, the desired needles are selected.

In this needle selection device, one pole contact is provided on one end of the selector and the end portion is provided on the other end of the selector, and the end portion is controlled by the cam to move the selector forwards. Hence the size of the selector in the longitudinal direction is great, and in turn the sizes of the carriage and the needle beds.

SUMMARY OF THE INVENTION

One object of the present invention is to provide a needle selection device that is more compact relative to the conventional ones by improving the selector, the select jack and the cam layout of the carriage.

Another object of the present invention is to make smaller the attracting forces of the permanent magnet and the electromagnet of the selector actuator and in turn to prevent incorrect needle selections by making the pole contact of the selector to be stably attracted onto the attraction site of the selector actuator.

The needle selection device of a flat knitting machine being provided with at least one pair of needle beds and a carriage reciprocating over the needle beds, each of said needle beds having plural needle grooves, and each of said needle grooves having a needle, a select jack and a selector therein according to the present invention wherein said selector has a tip on the select jack side and a tail on the opposite side thereof, said selector has, near the tip thereof, a rocking control means for controlling the rocking of the selector, said selector has, near the center thereof, a withdrawal control means for controlling the withdrawal of the selector from the select jack, said selector has, near the tail thereof, an advancement control means for controlling the advance of the selector towards the select jack, and said carriage is provided with a selector actuator for selectively and magnetically attracting and releasing a portion near the tail of the selector, at least two points, the first selection site and the second selection site, the first pressing cam means for making the selector contact the first selection site of the selector actuator by pressing the advancement control means, the first raising cam means for making the selector released at the first selection site advance towards the select jack by guiding the advancement control means, the second pressing cam means for making the selector contact the second selection site of the selector actuator by pressing the advancement control means of the selector advanced by the first raising cam means, the second raising cam means for making the selector released at the second selection site advance further towards the select jack by guiding the advancement control means, and a withdrawal cam means for making the selector advanced by either of said raising cam means withdraw away from the select jack by guiding the withdrawal control means.

Preferably, said rocking control means, said withdrawal control means and said advancement control means comprise butts provided on the selector on the carriage side thereof, and said selector actuator attracts and releases the portion of the selector opposite to the advancement control means.

Preferably, the selector is pressed by the select jack to protrude out of the needle groove, and the select jack is pressed to advance by the advancement of the selector towards the select jack.

Preferably, the carriage is provided with plural needle selection devices, and at least one of the needle selection devices is provided with the first raising cam means of the peak type, the second pressing cam means provided near the peak of the first raising cam means, the second raising cam means provides on both sides of the first raising cam means, and the first pressing cam means provided on both sides of the second raising cam means.

Preferably, the carriage is provided with a reference plane that is in contact with said rocking control means and serves as the reference plane for rocking of the selector.

Preferably, inclined surfaces are provided on both sides of said reference plane to prevent collision of the rocking control means and the reference plane.

The needle selection device of flat knitting machine according to the present invention uses a flat knitting machine having at least one pair of needle beds and a carriage reciprocating over the needle beds, each of said needle beds having plural needle grooves, and each of said needle grooves having a needle, a select jack and a selector, said carriage having a selector actuator having an attraction site comprising a permanent magnet and a release site comprising an electromagnet, said selector being arranged on the select jack for free sliding and rocking, said selector having a pole contact for being attracted or released by the selector actuator, and the selector being excited to release the pole contact from the selector actuator, said selector having a protrusion at the tip thereof for protruding out of the needle groove, and said carriage having a reference plane that contacts in plane with said protrusion when the pole contact is attracted by the selector actuator.

Preferably, the selector has its tip on the select jack side and its tail on the opposite side, and said protrusion is arranged near the tip of the selector, and said pole contact is arranged near the tail of the selector.

The present invention is a needle selection device of a flat knitting machine wherein needle selection is effected by selectively attracting and releasing the selector with a selector actuator having an attraction site and at least two selection sites using an electromagnet, and being characterized by a memory for recording the needle selection data of the fabric being knitted, and means for determining the magnitude of the drive signal of the electromagnet to drive according to the stored needle section data.

Preferably, the needle selection device is further provided with a first raising cam means of peak type, a second pressing cam means provided near the peak of the first raising cam means, a second raising cam means provided on both sides of the first raising cam means, and a first pressing cam means provided on both sides of the second raising cam means, and said means for determining said drive signal is configured so that the drive signal of the first selection site is determined on the basis of the number of selectors under the control of the first raising cam means, and the drive signal of the second selection site is determined on the basis of the number of selectors under the control of the second raising cam means.

In the present invention, inside the needle groove of the needle beds, one selector is mounted above one select jack. The first pressing cam means provided on the carriage presses the advancement control means on the tail of the sector, and the pole contact is attracted by the selector actuator. The selector actuator is provided with, in addition to an attraction site comprising a permanent magnet, etc., selection sites comprising two electromagnets located with an interval along the travelling direction of the carriage. Selectors that are selected by the preceding selection site will be released from the attraction, and selectors that are not selected will remain attracted. Butts constituting the advancement control means of the selectors that have been selected and released from the attraction will, for example, protrude out of the needle grooves and will move forwards under the influence of the following first raising cam means, and as a result, for example, butts of the select jacks will advance. The selectors that have not been selected will not receive any influence of the selector raising cam, and the butts of the corresponding select jacks will not advance.

Next, for the selectors that have advanced under the influence of the first raising cam means, the advancement control means, for example, butts, will be pressed by the second pressing cam means. As a result, the pole contacts will be attracted by the selector actuator again and selected by the following selection site. The advancement control means of the selectors released from the attraction will, for example, protrude out of the needle grooves, and will be advanced further by the following second raising cam means, and as a result, the select jacks will advance as well. In this way, the select jacks are selected to be in three positions. The selectors in the advanced position will be withdrawn by the withdrawal cam means back to the initial position or state before any needle selection.

When the selector passes the needle selection area, the rocking control means, such as protrusions formed in the tips of the selectors, will contact in plane with the reference plane provided on the carriage for positioning the selectors. This reference plane or guide plane serves as the reference plane for the selectors to rock under the influence of the pressing cam means. As a result, the pole contacts of the selectors can contact in plane with the selector actuator and the reliable attraction of the pole contacts is assured.

In the present invention, the number of selectors being attracted by the actuator is determined from the needle selection data, and from this number is determined the magnitude of the exciting current of the electromagnet. Determining the number of selectors is equivalent to determining the number of the complement of said selectors in the selectors present in a given area.

According to the present invention, the carriage and needle beds can be made smaller in size.

According to the present invention, plural cams having different functions can be integrally formed on the same cam, resulting in a smaller number of components and an easier assembly.

According to the present invention, pole contacts can be attracted reliably. As a result, the attracting force of the selector actuator can be made smaller, and at the same time, needle selection errors can be prevented.

According to the present invention, the selector actuator can be excited by an exciting signal of an appropriate size, and no magnetic sensor is required.

EMBODIMENT

A preferred embodiment of the present invention will be described with reference to the attached drawings. In the needle selection devices of the present embodiment, the needles are selectively guided to three positions: the advanced position is the knit position, the intermediate position is the tuck position, and the stationary position is the welt position, and they are called A position, H position and B position, respectively. The needle selection devices of the present embodiment can be utilized for stitch transfer, etc., and the stationary position is the initial position of the needle. In the present specification, a movement towards the trick gap between the pair of needle beds is defined as an advancement, and the movement in the opposite direction is defined as a withdrawal. With regard to cams of the carriage, one which is closer to the needles is defined as a higher cam, and one which is more distant from the needles is defined as a lower cam.

Figure 1:
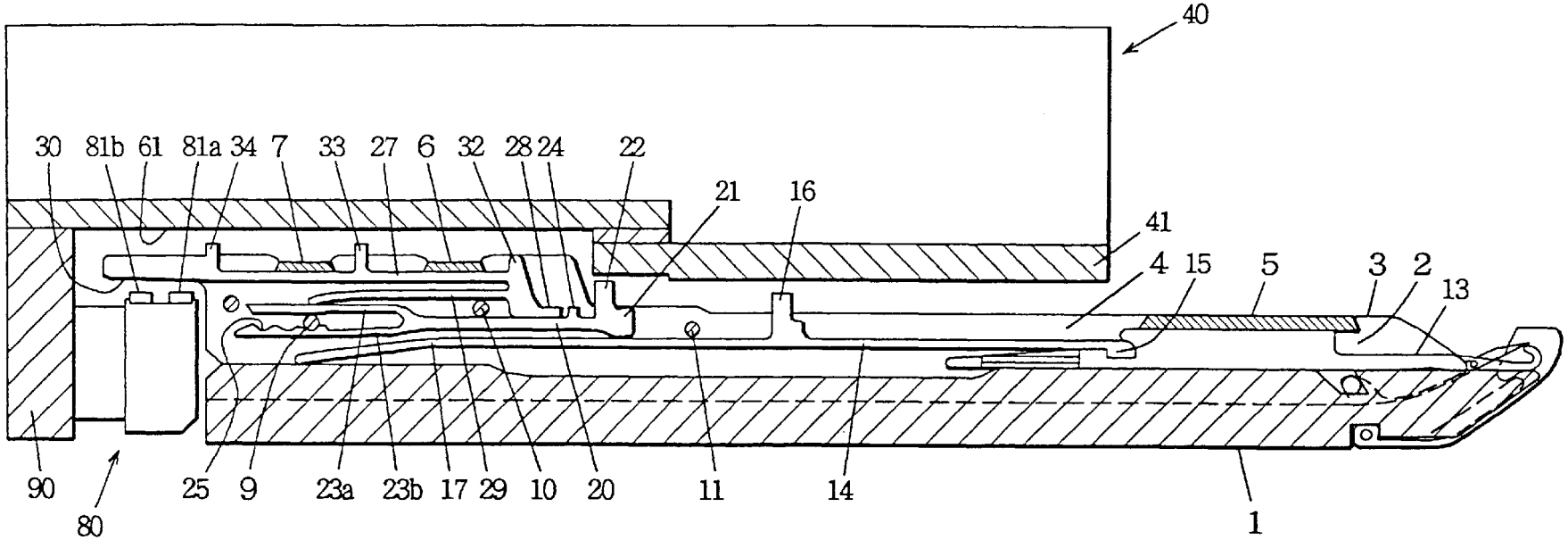
FIG. 1 is a sectional view of a needle bed of an embodiment of the present invention.

FIG. 1 shows the state before needles are selected by the carriage. The cams of the carriage are omitted for the convenience of explanation.

The needle bed 1 is provided with plural parallel grooves 2. Needle plates 3 are fit in said grooves 2, and the spaces between the respective two adjacent needle plates 3, 3 form needle grooves. A metal strip 5 is put through the row of multiple needle plates 3 to prevent the needles and the like from coming off. A needle 13, a needle jack 14, a select jack 30 and a selector 27 are slidably inserted in each needle groove 4.

The tip 15 of the needle jack 14 is fit in the tail of the needle 13. A needle jack butt 16 is formed at the center of the needle jack 14. An elastic support 17 provided in the tail of the needle jack 14 presses so that the needle jack butt 16 will protrude out of the needle groove. The butt 16 is a butt for controlling the needle, and the butt may be provided on the needle 13 in place of the needle jack 14. 11 denotes a wire which is put through the needle plates 3 to cross the needle grooves 4, and the wire 11 contacts the top of each needle jack 14 and limits the highest position of the butt 16.

20 denotes the select jack, and its tip 21 is located above the needle jack 14, and the top of the select jack 20 contacts a wire 10. The select jack 20 is provided, at its tail, with fork ends 23*a, b*. The fork ends 23*a, b* contact a wire 9. The wires 9, 10 pierce the needle plates 3 and hold the select jacks 20 in the respective needle grooves. The needle jack 14 tends to protrude out of the needle groove, and this elastic force is transmitted to the tip 21 of the select jack 20, and the select jack butt 22 is pressed to protrude out of the needle groove. The select jack 20 reciprocates in the needle groove, and its most advanced position is one in which the tip 21 is in contact with the wire 11. Under this condition, the butt 22 is in the A position. Three dents 25 formed in the top of the lower leg 23*b* of the fork end determines the respective positions A, H and B. One dent 25 and the upper leg 23*a* work together to hold the wire 9. A butt 24 is provided on the top of the jack 20 a little behind the butt 22. The selector 27 is arranged above the jack 20, and the tip 28 of the selector 27 is associated with the butt 24. The carriage is provided with a select jack presser which will be described later, and when the select jack presser presses the jack 20 into the needle groove, the but 16 of the jack 14 will also sink into the needle groove and its association with the needle control cam of the carriage will be lost.

The selector 27 is arranged above the jack 20, and an elastic leg 29 of the selector 27 is compressed and deformed by the metal strips 6, 7 pierced through the needle plates 3 and by the jack 20. The selector 27, under this condition, is kept inserted in the needle groove; the selector 27 is always pressed to extrude out of the needle groove. The selector 27 is provided, at the top end thereof, with a tip 28 which is associated with the butt 24 to advance the jack 20 to the H position or the A position. The selector 27 is also provided, at the tail thereof, with a pole contact 30 which is attracted by a selector actuator 80 which will be described later. When the selector 27 is set in the needle groove 4, the pole contact 30 will protrude from the tail end of the needle groove 4. Three butts 32, 33 and 34 are formed, in this order from the tip thereof, on the top of the selector 27.

Figure 2:
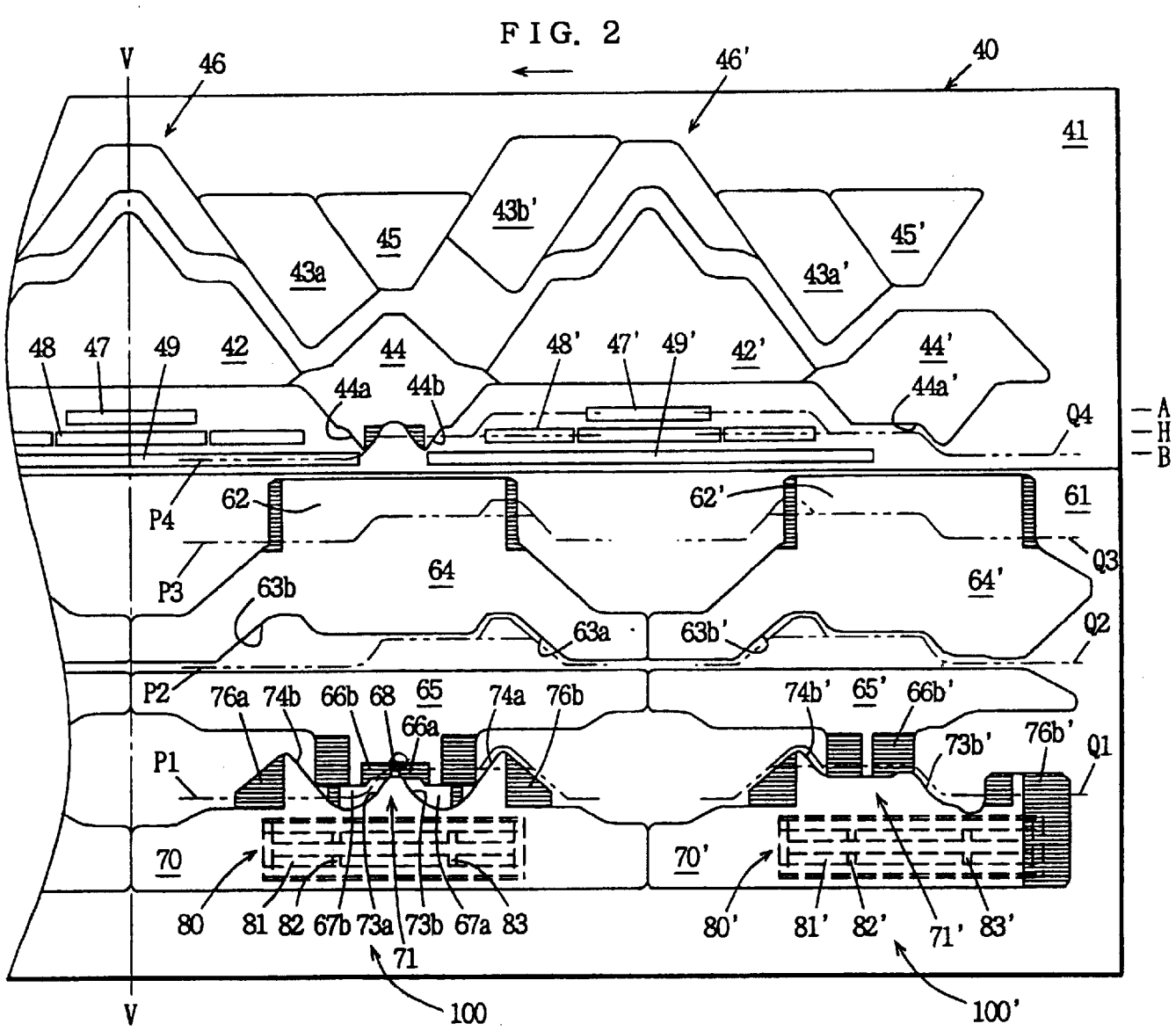
FIG. 2 is a diagram showing the cam arrangement of the carriage of the embodiment.

Now, the carriage 40 will be described. FIG. 2 shows the right half of the carriage 40 which has a bilateral symmetry, and the line V—V in the diagram is the center line of the carriage 40. The carriage 40 is provided with three knitting locks, and there are a total of four selection devices 100, 100' between the knitting locks and on the sides of the outermost knitting locks. Each selection device sorts out every needle to one of the three positions A, H and B. The hatchings in the diagram show inclined planes that act on the tops of the butts of the selectors. The cams that work when the carriage moves leftwards as shown in the diagram are indicated by a mark a, and those that act when the carriage moves rightward are indicated by a mark b, respectively. The carriage 40 is provided with a selector plate 61 and a cam plate 41, and the selector plate 61 controls the selectors 27. The cam plate 41 is closer, than the selector plate 61, to the needle bed 1, and controls the butts 22 and the butts 16. The cam plate 41 is provided with the center knitting lock 46 and the knitting locks 46' on both ends. Since their constructions are almost identical, the center knitting lock 46 will be described. The parts having the common function in the carriage are indicated by similar marks.

The knitting lock 46 is provided with a needle raising cam 42, and a pair of stitch cams 43, 43 are provided on both sides of the needle raising cam 42. The stitch cams 43 can slide parallel to the inclined planes of the raising cam 42. 44 and 45 are guide cams for guiding butts 16. These cams constitute cams that control needles. Cam surfaces 44*a*, 44*b* are formed on the bottom of each guide cam 44 to act on butts 22 that have been advanced by needle selection to restore the select jacks to their initial positions (B position). Select jack pressers 47, 48 and 49 that selectively work and can appear freely are provided beneath the raising cam 42. These select jack pressers act on the select jacks that have been sorted into three positions A, H and B to press the butts 22 back into the needle grooves.

The selector plate 61 is provided with selector guide cams 64, 65 and 70 between the knitting locks. The cam 65 and the cam 70 may be united. The upper portion of the lowest selector guide cam 70 constitutes a W-shaped selector raising cam 71 to control the selector butt 34. An H position raising cam 73 comprising cams 73*a*, 73*b* is provided at the center of the W-shaped cam to advance, via the selector 27, the select jack 20 to the H position. An A position raising cam 74 comprising cams 74*a*, 74*b* is provided on both outer sides of the H position raising cam 73 to advance the select jack to the A position. A first selector pressing cam 76 comprising selector pressing cams 76*a*, 76*b* is provided on both outer sides of the A position raising cam 74 to press the butt 34 to sink it into the needle groove and make the pole contact 30 to be attracted onto the attraction site of the actuator 80.

The highest selector guide cam 64 is provided with a selector lowering cam 63 comprising lowering cams 63*a*, 63*b* to control the butt 33 and make the advanced selector 27 withdraw to the initial position. The guide cam 64 is provided with a selector positioning guide face 62 to position the selector, when it is attracted by the actuator 80, by contacting in plane with the butt 32.

The selector guide cam 65 constitutes the second selector pressing cam 66 comprising cam surfaces 66*a*, 66*b* of bilateral symmetry. This cam 66 is located above the cam 73 and presses the butt 34 of the selector 27 that have advanced to the H position to make the pole contact 30 to be attracted again onto the attraction site of the actuator 80. The intermediate portion 68 between the cam surfaces 66*a* and 66*b* is the surface of the selector plate 61. A guide cam 67 is provided on the bottom of the second selector pressing cam 66. This guide cam 67 is higher than the selector plate 61 and is lower than the selector raising cam 71. In the present specification, with regard to the highness and lowness of the carriage, a position closer to the needles is defined as a higher position, and a position more distant away from the needles is defined as a lower position.

Figure 3:
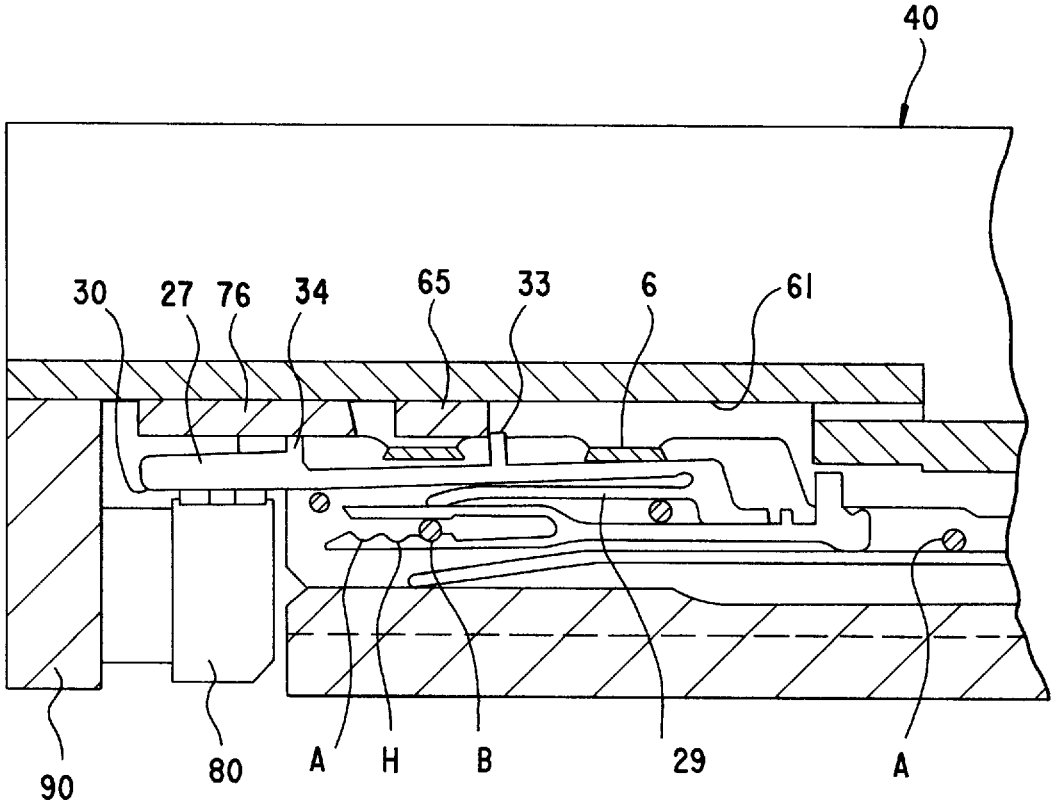
FIG. 3 is a sectional view showing the needle selecting device of the embodiment. The position stabilization mechanism of the selector is deleted in the diagram.

As shown in FIG. 3, the selector plate 61 protrudes backward beyond the tail end of the selector 27. A bracket 90 having an L-shaped section is provided on this protruding portion of the selector plate 61, and a selector actuator 80 is mounted to oppose the pole contacts 30. The actuator 80 is provided with two upper and lower rows of attraction sites 81*a*, 81*b* magnetized by permanent magnets and with the first selection sites 82 and 83 arranged with an appropriate interval. The selection sites 82 and 83 comprise pole pieces 82*a*, 82*b*, 83*a* and 83*b* of the electromagnetic coils of the exciting release type electromagnets.

The selector positioning guide surface 62 stabilizes the rocking position of the selector 27 and has a width equal to the full width of the actuator 80. Now, a case where the butt 32 and the guide surface 62 are hypothetically eliminated is shown in FIG. 3. The elastic leg 29 raises the selector butt 34 upwards, and the cam 76 pushes the butt 34 into the needle groove to make the pole contact 30 to be attracted onto the attraction site 81. When the guide surface 62 and the butt 32 are provided to the case of FIG. 3, one will get the case of FIG. 5. In FIG. 3, the selector 27 is pressed by the cam 76, and the selector 27 will rock in the counterclockwise direction with the tip of the elastic leg 29 serving as the fulcrum. The top of the selector 27 will contact the metal strip 6 to stop. Hence this metal strip 6 serves as the reference plane for determining the contact between the pole contact 30 and the attraction site 81.

The metal strip 6, however, is designed to prevent the selectors 27 from coming off the needle grooves, and is not regular over the full width of the needle bed because the strip is long. It is not appropriate to use the metal strip 6, which is provided for such a long object as the needle bed, as the reference plane. As a result, the displacement of the selector when it is pressed can not be regular. When the displace is excessive, an angle is generated between the pole contact 30 and the attraction site 81, resulting in a point contact. As a result, if the attraction force is not very large, the pole contact 30 may come off the attraction site 81, causing erroneous needle selection. This, in turn, requires the use of powerful permanent magnets and coil poles to prevent needle selection errors. As a result, the actuator will become larger, the power consumption will become greater, and magnetic flux leakage will cause unstable operation.

In contrast to the case mentioned above, in the needle selection device of the embodiment, when the butt 34 is pressed, the butt 32 will come into contact with the guide surface 62 of the carriage 40. Hence the rocking of the selector 27 is made with the guide surface 62 serving as the reference; the selector in any position on the needle beds is rocked under the same conditions. The height of the guide surface 62 is set in such a way that when the butt 34 is pressed by the cam 76, the pole contact 30 will contact in plane with the attraction site 81. As a result, in the case of FIG. 5, the attracting force of the actuator 80 can be reduced to ½~⅕ of that of the case of FIG. 3; the size of the actuator, in turn, can be reduced. This results in smaller flux leakage and stabler needle selection.

Figure 4:
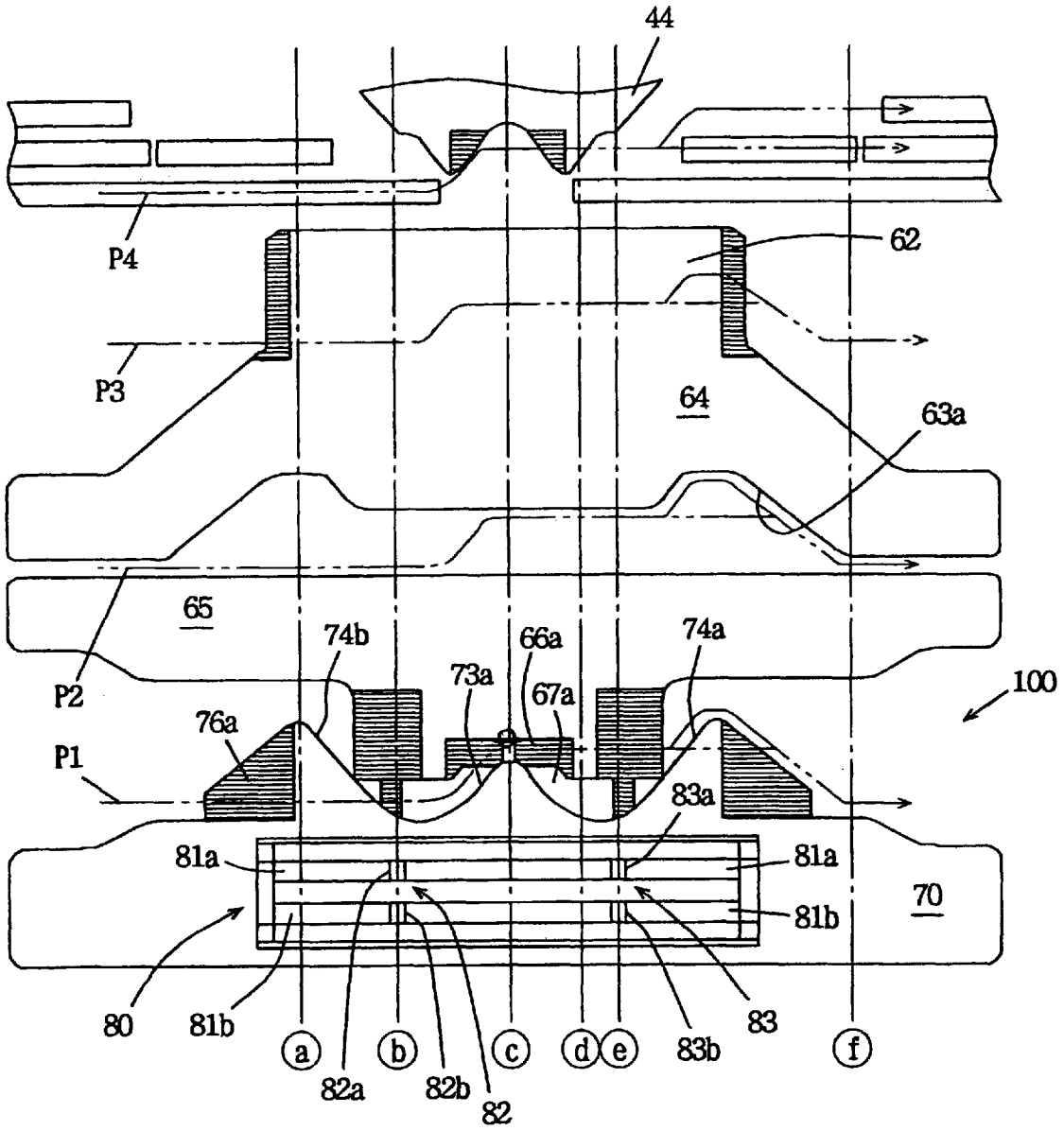
FIG. 4 is a magnified view of a part of the cam layout of the needle selection device of the embodiment. The diagram shows the actions of the cams at their respective positions.
Figure 5:
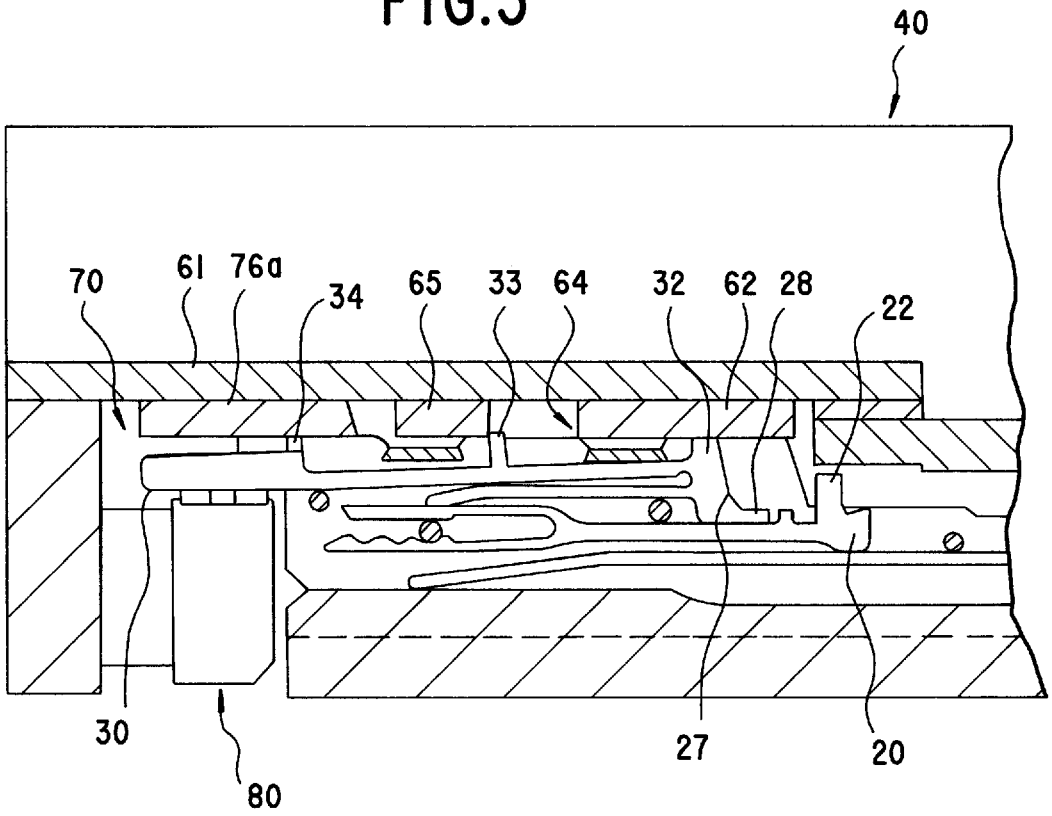
FIG. 5 is a diagram showing the selector is attracted by the selector actuator under the influence of the first selector pressing cam.
Figure 6:
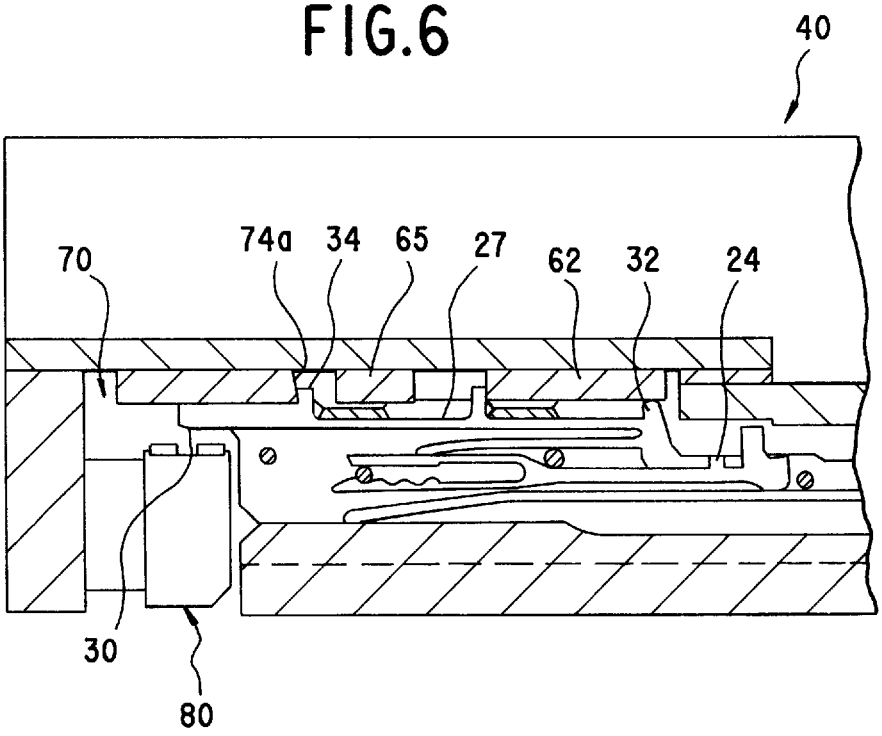
FIG. 6 is a diagram showing the selector advanced by the selector raising cam.

The operation of the selection device will be described with reference to FIG. 4, FIG. 5 and FIG. 6. The case of the carriage moving to the left is used as an example, and the operation of the selection device 100 arranged between knitting locks will be described. P1, P2 and P3 in the diagram show the loci of the butts 34, 33 and 32. P4 shows the locus of the butt 22. In FIG. 4, the actuator 80 is indicated with full line.

The selector 27 is at first in the state of FIG. 1. When the carriage 40 moves, the butt 32 will come into contact with the guide cam surface 62 at the position a, next the butt 32 will be positioned by the guide surface 62. The butt 34 will be pushed into the needle groove by the cam 76*a*, and as shown in FIG. 5, the pole contact 30 will come into contact with the attraction site 81 and be attracted by it, and the pole contact 30 will move to the first selection site 82 comprising the coil pole piece 82.

At the position b, needles are sorted out by the first selection site 82 into those needed for knitting and those not needed for knitting. When the pole contact 30 of the selector 27 of a needle needed for knitting arrives at the coil pole piece 82, the coil will be excited to cancel the magnetic flux of the permanent magnet and terminate the attraction at the coil pole piece 82. As a result, the selector 27 being released from the attraction will rise because of the force of the elastic leg 29, and the selector butt 34 will come out of the needle groove and will be controlled by the needle raising cam 73. For needles not required for knitting, even when the selector 27 thereof reaches the coil pole piece 82, the coil pole will not be excited, and as a result, the selector 27 will be kept attracted.

At the position c, for the selector 27 that has been released from the attraction with the excitation of the coil pole piece, the butt 34 is guided along the cam 73*a* to the peak of the cam. Therefore, the tip 28 of the selector 27 makes the select jack 20 advance to the H position. Thus, for all needles necessary the knitting operation, their select jacks 20 are sorted out to the H position.

At the position d, for the selector 27 that have been selected to the H position, the butt 34 will be pushed by the cam 66*a* into the needle groove. The cam 66*a* is a pressing surface provided on the cam 65, and the cam 65 is above the cam 73*a*. Hence the pole contact 30 will come into contact with the attraction site 81 again, and will move to the second selection site 83. The guide cam 67*a* prevents the butt 34 from withdrawing.

At the position e, the selector 27 is sorted out further by the second selection site 83. In the same manner as the first selection, selectors 27 corresponding to the needles to be selected to the A position are released from the attraction on the coil pole piece 83 by exciting the coil. The butt 34 of the selector 27 that has been released from the attraction will protrude out of the needle groove and will be guided by the following A position raising cam 74*a* to advance to the apex of the inclined surface. As clearly seen in the diagram, the apex of the cam 74 is more advanced than the apex of the cam 73. As a result, the select jack 20 will advance to the A position.

At the position f, the selector 27 that have been advanced by the cam 71 will be withdrawn to the initial position hence the butt 38 is withdrawn by the selector lowering cam 63*a*.

In this way, each select jack 20 is sorted out to one of three positions A, H and B in one stroke of the carriage 40. The following pressers 47, 48 and 49 that can appear freely act on the butt 22 to determine the locus of the butt 16 of the needle jack 14. As a result, which locus of the knitting lock the needle 13 takes will be determined; thus various knitting of knit, tuck and miss will be made.

Marks Q1 through Q4 of FIG. 2 show the loci of the butts 34, 33, 32 and 22 when the carriage travels to the right. 100' is the selection device at the edge of the carriage.

Modification

Figure 7:
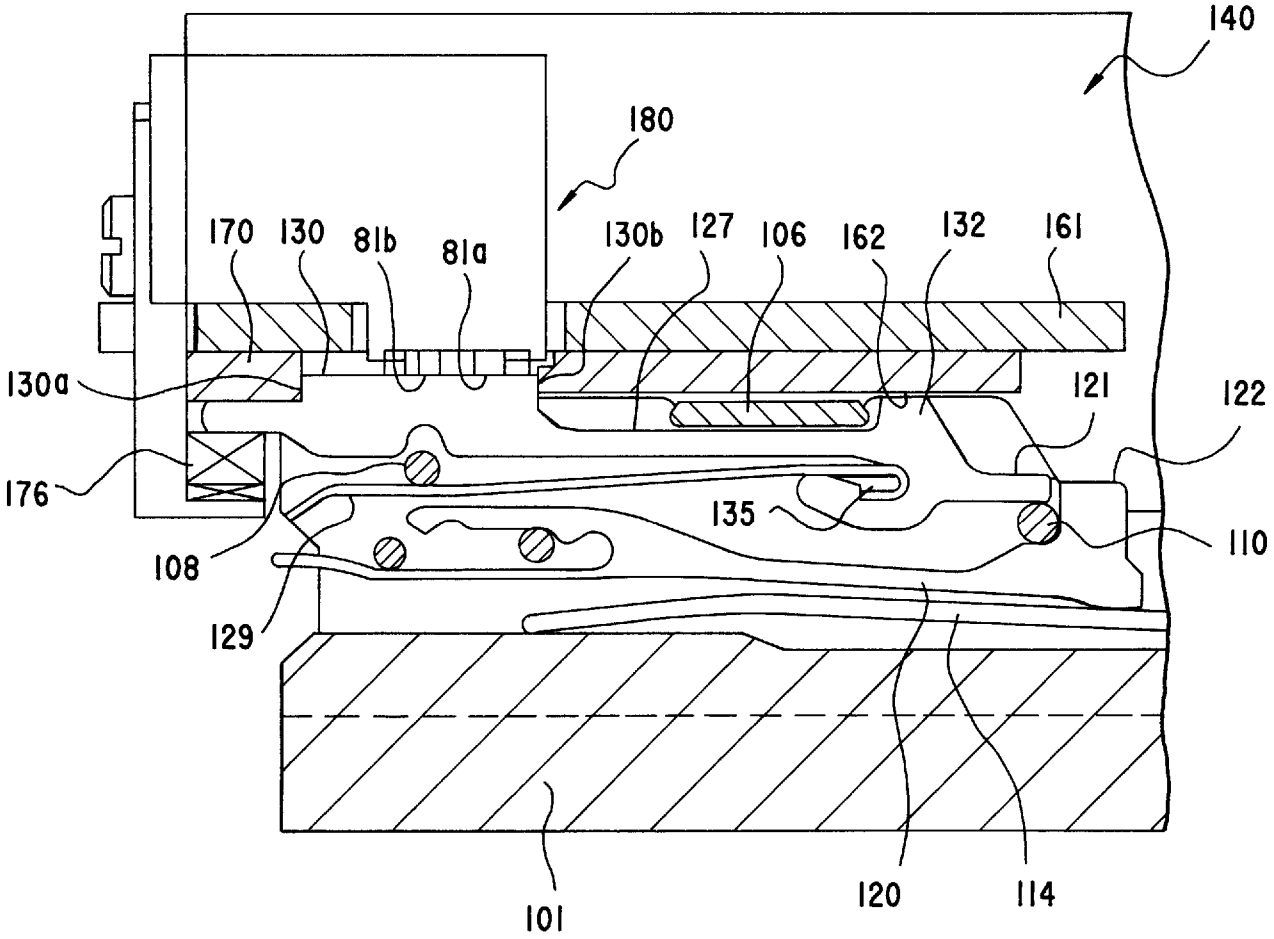
FIG. 7 is a diagram showing a modification for stabilizing the selector.

A needle selection device of a modification according to the present invention is shown in FIG. 7. This modification shows an application of the selector positioning guide, and the marks similar to those of FIG. 1 through FIG. 6 show similar parts. 180 is a selector actuator of which construction is identical to the one mentioned above, and it releases the pole contact 130 when excited. 140 is a new carriage. 161 is a new selector plate. 101 is a new needle bed. 127 is a new selector. 120 is a new select jack, and 114 is a new needle jack. 108 and 110 are new wires, 106 is a new metal strip, and 122 is a butt of the select jack 120. 121 is the tip of the selector 127. 170 is a new selector raising cam. The selector 127 has a fitting part 135 into which a leaf spring 129 is fit, and is pressed in the direction that the pole contact 130 sinks into the needle groove. 130*a* is a surface that associates with the selector raising cam 170. 130*b* is a surface that associates with the selector lowering cam. A butt 132 for needle selection stabilization is formed on the top of the selector 127. A selector raising cam 176 is provided on the lower end of the selector plate 161, and this cam resists against the elastic pressing of the leaf spring 129 to push up the pole contact 130 of the selector 127 out of the needle groove. As a result, the pole contact 130 will be attracted onto the attraction site of the actuator 180. With the butt 132 of the selector 127 being in contact with the guide surface 162, the selector 127 will rock. Hence the movement of the selector in the needle groove is regulated. As the selector 127 rocks with the guide surface 162 serving as the reference plane, if the height of the guide surface 162 is adjusted so that the pole contact 130 and the actuator 180 contact with each other in plane, the effects similar to FIG. 1 through FIG. 6 can be obtained.

Control of the selector actuator

With regard to the control of the selector actuator 80, a variety of systems have been known to the present. One important point for this control is to determine the coil currents for the selection sites 82, 83 according to the attracting force of the attraction site 81. Regarding this point, for example, the Japanese Provisional Patent Publication Sho-62-263,358 (U.S. Pat. No. 4,715,198) discloses the use of Hall effect device for measuring the attractive force of the attraction site 81. The control of the selector actuator 80 may be done by such a conventional method. In the following, however, a preferred example will be described. In this case, the needle selection data itself is used to decide the coil currents to the selection sites 82, 83, eliminating the need of magnetic sensors such as Hall effect device. The point here is that the variation in the attractive force of the attraction site 81 is determined by the number of selectors 20 being attracted by the selector actuator 80.

Figure 8:
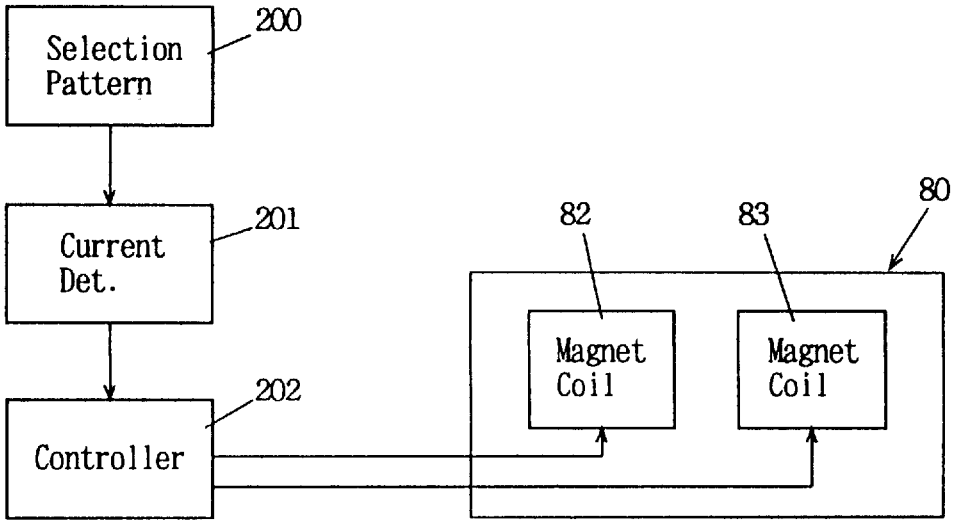
FIG. 8 is a block diagram showing the control of the selector actuator in the embodiment.

The control circuit of the selector actuator 80 is shown in FIG. 8. In this diagram, 200 denotes a memory for the needle selection pattern which stores the needle selection data being a part of the knitting data. 201 denotes a coil current determiner which determines the coil current according to the needle selection data. 202 denotes a controller which determines, on the basis of the coil current determined above, the coil currents for the respective electromagnets of the selection sites 82 and 83. Assume that the carriage travels to the left. The needle selection data to be referred to for controlling the selection site 82 is the number of selectors 20 being attracted onto the attraction site 81 between b and c of FIG. 4. This is obtained by subtracting the number of needles selected to the H position (the number of selectors being under the influence of the cam 73*a*) from the number of needles present in the area between b and c. The needle selection data to be referred to for controlling the needle selection site 83 is the number of selectors 20 being attracted onto the area between e and the right end of the attraction site 81 in FIG. 4. This number is obtained by subtracting the number of needles selected to the A position from the number of needles present in this area.

According to the findings of the present inventors, when a large number of selectors 20 are attracted, the attracting force of the attraction site 81 will decrease. This is because the magnetic flux of the attraction site 81 is distributed to the large number of selectors 20. The number of the selectors 20 attracted by the attraction site 81 varies according to the needle selection pattern. For example, when all needles take the B position, the number being attracted will be maximal. When all needles take the A position, the number being attracted will be minimal. As the needle selection pattern is known, the number of selectors 20 being attracted by the attraction site 81 can be determined from it.

With reference to FIG. 4 again, the determination of the coil current will be described below. The total number of the needles present in the range of the attraction site 81 is determined by the pitch of the needles and is known. In the range between a and b of FIG. 4, all selectors are attracted, and the number of selectors present here is constant. Similarly, all the selectors are attracted in the range between c and e, and in this range c–d the selectors are pressed by the cam 66*a*, and this is equivalent to being attracted. Around the selection site 82, it is between b an c in FIG. 4 where the number of selectors being attracted varies. Here the selectors under the influence of the cam 73*a* are not being attracted. The total number of selectors to be present in the range b–c of FIG. 4 is known from the pitch of the needles. When the number of selectors having been selected to the H position and being under the influence of the cam 73*a* is subtracted from the above-mentioned known total number of selectors, the number of selectors being attracted to the range b–c will be determined.

Similarly, the selectors not being attracted around the needle selection site 83 are only the selectors that are changing to the A position under the influence of the cam 74*a*. Hence the number of selectors presently being under the influence of the cam 74*a* is subtracted from the total number of selectors to be present up to the right end of the attraction site 81 (known from the pitch of the needles). In the embodiment, for the sake of convenience, selectors to be selected presently are eliminated from the number of the selectors. When the carriage travels towards the right, the range c–e and the left range beyond b are important. Hence the number of selectors being attracted in these ranges is to be determined.

Now refer to FIG. 8 again. As the pitch of the needles and the distribution of selectors in various parts of the actuator 80 are known from the needle selection data. On the basis of this, and by using the following table for reference, the coil currents will be decided to control the needle selection sites 823 and 83. The upper portion of the table is for normal control that changes the coil current according to the number of selectors. The lower portion is for summary control.

TABLE 1

Table for Determining the Coil Current

| Number of selectors being attracted | Coil current (A) |
|---|---|
| Normal control | |
| 0 | 0.70 |
| 1 | 0.66 |
| 2 | 0.63 |
| 4 | 0.60 |
| Summary control | |
| 0~1 | 0.68 |
| 2~4 | 0.62 |

We claim:

1. A needle selection device of a flat knitting machine being provided with at least one pair of needle beds and a carriage reciprocating over the needle beds, each of said needle beds having plural needle grooves, and each of said needle grooves having a needle, a select jack and a selector therein wherein said carriage has a selector actuator having an attraction site comprising a permanent magnet and a release site comprising an electromagnet, said selector is arranged on the select jack for free sliding and rocking, said selector having a pole contact at one end thereof for being attracted or released by the selector actuator, and the selector being excited to release the pole contact from the selector actuator, said selector has a tip on an opposite end from the pole contact, the tip having a protrusion for protruding out of the needle groove, and said carriage has a reference plane that contacts in plane with said protrusion when the pole contact is attracted by the selector actuator.

2. A needle selection device of flat knitting machine of claim 1 being characterized in that the selector has the tip on the select jack side and the tail on the opposite side, that said protrusion is arranged near the tip of the selector, and that said pole contact is arranged near the tail of the selector.

* * * * *